US006726495B2

(12) United States Patent
Hirschmann

(10) Patent No.: US 6,726,495 B2
(45) Date of Patent: Apr. 27, 2004

(54) INSULATING BODY

(75) Inventor: Michael Hirschmann, Leingarten (DE)

(73) Assignee: Amphenol-Tuchel Electronics GmbH (DE)

( * ) Notice: Subject to any disclaimer, the term of this patent is extended or adjusted under 35 U.S.C. 154(b) by 0 days.

(21) Appl. No.: 10/247,515

(22) Filed: Sep. 20, 2002

(65) Prior Publication Data

US 2003/0060070 A1 Mar. 27, 2003

(30) Foreign Application Priority Data

Sep. 26, 2001 (DE) ..... 101 47 967

(51) Int. Cl.[7] ..... H01R 29/00

(52) U.S. Cl. ..... 439/188; 439/352; 439/353; 439/358; 439/752; 174/138; 174/152 G

(58) Field of Search ..... 439/188, 352, 439/353, 357, 358, 511, 512, 513, 752, 959; 174/138, 152 G

(56) References Cited

U.S. PATENT DOCUMENTS

| | | | | |
|---|---|---|---|---|
| 5,334,025 | A | * | 8/1994 | Fohl |
| 5,529,507 | A | * | 6/1996 | Felix et al. |
| 5,613,865 | A | * | 3/1997 | Dullin et al. |
| 6,083,057 | A | * | 7/2000 | Annecke et al. |
| 6,319,042 | B2 | * | 11/2001 | Hirschmann |
| 6,518,506 | B2 | * | 2/2003 | Zink et al. |

FOREIGN PATENT DOCUMENTS

| | | |
|---|---|---|
| DE | 195 13 358 | 11/1997 |
| DE | 199 35 969 | 1/2001 |
| DE | 199 35 970 | 2/2001 |

* cited by examiner

*Primary Examiner*—Anthony Dinkins
*Assistant Examiner*—Nguyen T. Ha
(74) *Attorney, Agent, or Firm*—Blank Rome LLP

(57) ABSTRACT

An insulating body for installation in a (gas) generator as a component of a plug-in connector system having a generator and a plug for inflatable restraint systems in motor vehicles is described.

10 Claims, 2 Drawing Sheets

INSULATING BODY

BACKGROUND INFORMATION

Figure 1:
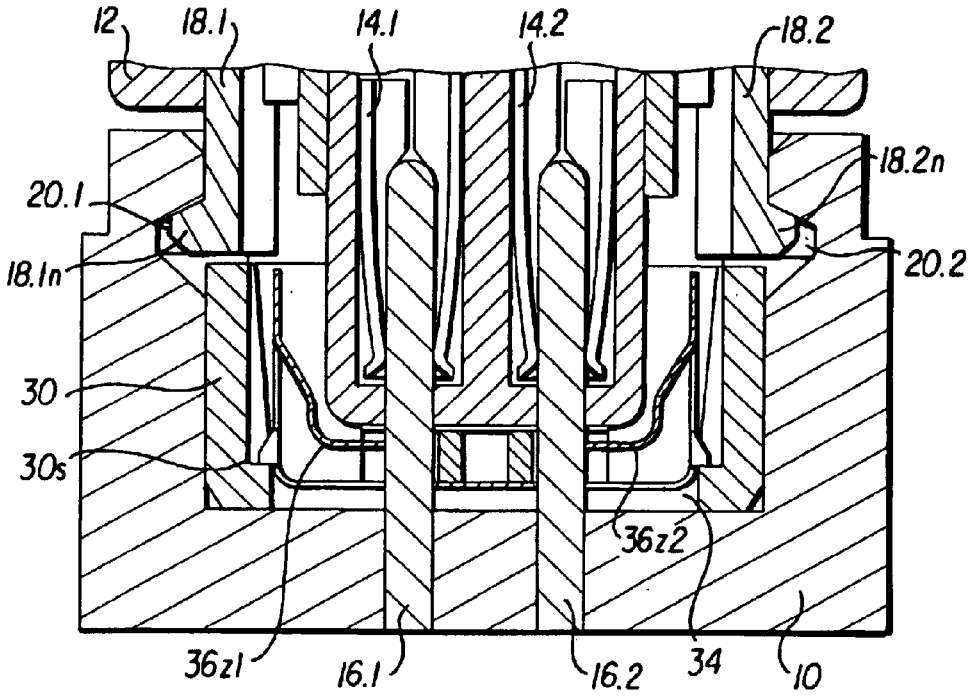

The present invention relates to an insulating body for installation in a (gas) generator as a component of a plug-in connector system having a generator and plug for inflatable restraint systems in motor vehicles.

Insulating bodies of this type are known, for example, from German Published Applications 199 35 969 and 199 35 970. The insulating bodies are used for, among other things, receiving a short circuit spring, which is in two parts according to German Patent Application 199 35 970 A1 and which must be positioned in a complicated way in the insulating body according to German Patent Application 199 35 969 A1.

For plug-in connectors of the type described, it is required, among other things, that the contact pins arranged in the region of the generator (a box) are arranged so they are shockproof against a scoop-like insertion of the forward housing edge of the mating connector (also called "scoop proof"). This is to prevent, for example, in the event of slanted insertion of the plug onto the contact pins of the box (of the generator), the contact pins from being bent and improper contacts possibly occurring.

For this purpose, shortening the contact pins is known, so that they may only be grasped by the associated contact springs after a defined guide path of the plug.

However, this measure is not possible in every case. Certain plug systems are defined according to their dimensions.

This is where the object the present invention is based on begins. A possibility is to be indicated for providing the required plug safety even without shortened contact pins and without other changes in the dimensions of the plug-in connector system.

It is to be taken into consideration in this case that, on one hand, the contact pins for the plug connections must be placed in the region of the generator and/or an insulating body arranged in the generator, and, on the other hand, the short circuit spring cited must also be placed here, the function of this spring only able to be removed when the plug and the generator (box) are completely in their locked position.

A first starting point for a constructive suggested solution is as follows: typically, opposing elastic latching tongues are present on the plug, which snap into corresponding latching recesses of the generator housing in the locked position in relation to the box. In this region, the box housing must therefore already have a corresponding opening in order to allow the catches to snap in. Typically, movable secondary locks (pins or bars) are provided directly behind these catches in the plugging direction, which prevent the catches from being able to move back out of the latching openings unchecked.

For these secondary locks, it is also known (German Patent Specification 195 13 358 C1) that they are simultaneously used to neutralize a shortening means between corresponding contact pins.

For this purpose, the secondary lock according to German Patent Specification 195 13 358 C1 has—viewed in horizontal section—a U-shape, the neutralization of the short circuit function being performed by the basis (bottom) leg. In other words: a common short circuit spring lies on corresponding sections of neighboring contact pins and is pushed away when the secondary locking means is inserted.

Therefore, in regard to the space required, appropriate room must be provided both in the movement direction of the short circuit spring and perpendicular thereto, i.e., in the movement direction of the catches cited.

In contrast, it is provided according to the present invention that the movement direction of the short circuit spring be set corresponding to the movement direction of the latching arms, because the space necessary already exists in this direction.

In its most general embodiment, the present invention therefore relates to an insulating body for installation in a generator as a component of a plug-in connector system having a generator and a plug for inflatable restraint systems in motor vehicles, having the following features:

- The insulating body has guides running parallel to the plugging direction for receiving two contact pins,
- the guides run over the entire height of the insulating body from a lower face to an upper face,
- a U-shaped short circuit spring, which is constructed as follows, is arranged in the insulating body:
  - A bottom leg runs parallel to the lower face of the insulating body,
  - two U-legs run in the direction toward the upper face of the insulating body,
  - contact tongues pointing toward one another, which each press against a contact pin when the plug connector is not plugged in, project from the U-legs.

In this case, the short circuit spring may be in one part. It may have at least two recesses in the bottom leg, which encompass the contact pins with clearance. In this way, the short circuit spring runs on the bottom (with its bottom leg) more or less around the contact pins, the bottom leg only being used in the final analysis for assembly in the insulating body. The actual short circuit function is assumed by the contact tongues directed toward one another which have a conductive contact to the bottom leg, and which may, for example, be cut out of the material of the U-leg.

The arrangement of the short circuit springs may be such that the U-legs run essentially parallel to the secondary lock elements of the associated plug and the contact tongues are directed toward one another in such a way that they are engaged by the secondary lock elements when these elements are guided into the final position. At the same time, the contact tongues are pushed away in the same direction in which the latching arms move when they snap into the corresponding latching recesses of the box.

The insulating body, which is used in an associated gas generator, may, for example, have a more or less round cross-sectional area, and may have an external diameter which essentially corresponds to the distance of the outside faces of the opposing latching arms of the plug. It is also clear from this that no dimensional enlargement of the generator is necessary for the construction described.

In order to be able to position the short circuit spring, particularly when it is in one piece, in the insulating body at all, one embodiment of the present invention provides that the insulating body has an opening in its lower face which is slightly smaller (e.g. shorter) than the bottom leg of the short circuit spring. In this way, the short circuit spring may be "levered in" via the opening and subsequently aligned in the desired position in the insulating body. The following description of the figures shows an example of this.

By these means, the external dimensions of the opening in the lower face may be tailored to the external dimensions of the bottom leg of the short circuit spring. If the bottom leg of the short circuit spring is, for example, more or less rectangular, then the recess may also be rectangular.

The short circuit spring may have openings or cutouts in its bottom leg, through which the contact pins are guided (with clearance). However, is also possible to make the bottom leg, for example, meander-shaped and thus provide opposing lateral openings for the contact pins.

A further possibility for the opening/recesses in the short circuit spring is to continue recesses in the bottom leg into the lateral U-legs and simultaneously cut out the contact tongues. This embodiment is also illustrated in the following embodiment.

The insulating body may be preassembled with the short circuit spring. At the same time, the short circuit spring may be assembled into the insulating body via appropriate projections, possibly even (solely) due to a certain tensioning. The insulating body itself may be glued into an associated gas generator.

The spring may be constructed as a combined spiral and/or torsion spring.

Further features of the present invention result from the features of the sub-claims and the other application documents.

The present invention is described in more detail in the following with reference to an exemplary embodiment.

Figure 2:
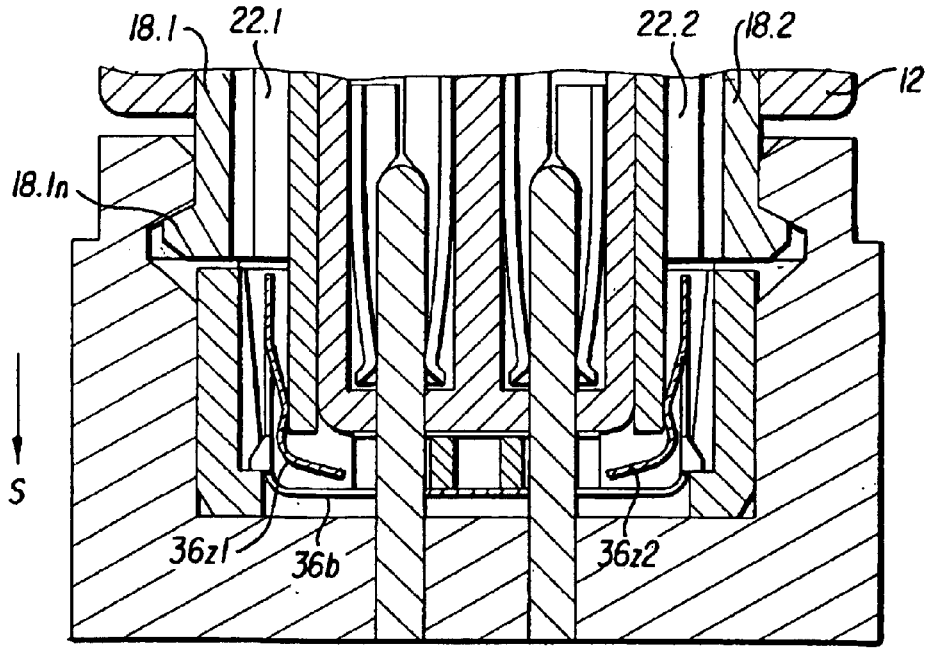
Figure 3:
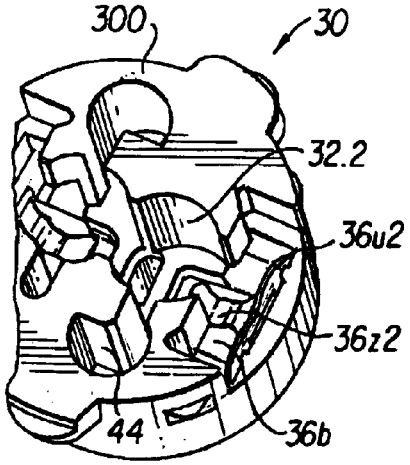

FIG. 1: shows a partially cut away longitudinal section through a plug-in connector system in the unlocked state FIG. 2: is the same as FIG. 1, but in the locked state FIG. 3: shows a perspective view from the plug side of an insulating body in the gas generator shown in FIGS. 1 and 2

Figure 4:
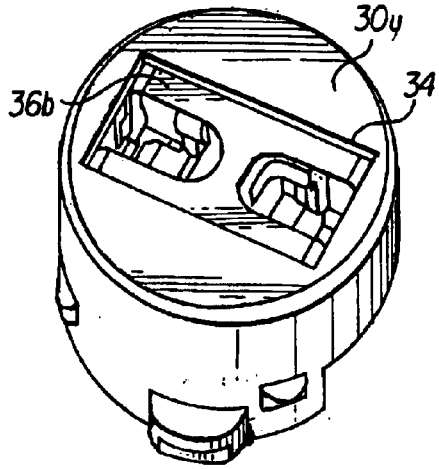

FIG. 4: is the same as FIG. 3, but a view from the generator side

Figure 5:
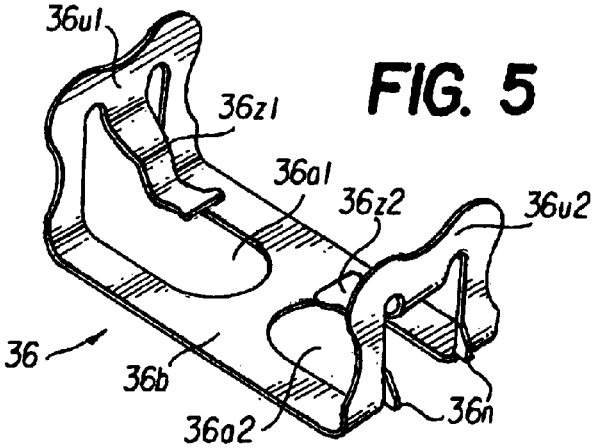

FIG. 5: shows a perspective view of the short circuit springs shown in FIGS. 1, 2

Figure 6:
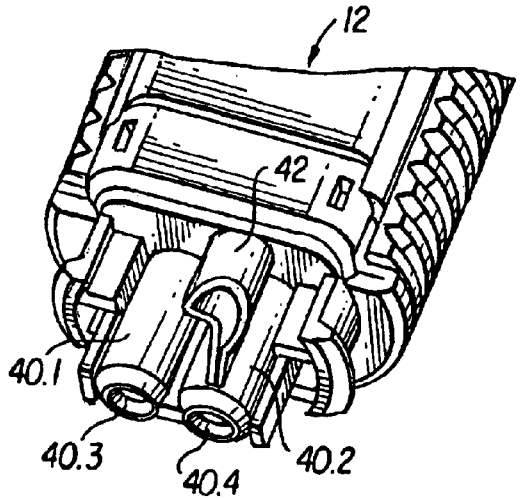

FIG. 6: shows a perspective view of the plug part of the plug shown in FIGS. 1, 2.

Identical components or components having identical functions are indicated with the same reference numbers in the figures.

In FIGS. 1 and 2, a box (a gas generator) 10 and the lower part of an associated plug 12 may be recognized, which together form a plug-in connector system. Plug 12 is implemented in a typical way having contact springs 14.1, 14.2, which are to be contacted by associated contact pins 16.1, 16.2, which are a component of generator 10.

In addition to contact springs 14.1, 14.2, latching arms 18.1, 18.2, having catches 18.1*n*, 18.2*n* directed outward, run on opposite sides of plug 12 in plugging direction S, which, when plug 12 is placed on generator 10, are first guided inward (toward one another), before they each snap outward into corresponding latching openings 20.1, 20.2 of the peripheral wall of generator 10.

Directly behind latching arms 18.1, 18.2, movable elements 22.1, 22.2 run in plugging direction S for secondary locking of latching arms 18.1, 18.2. Insulating body 30, illustrated in FIGS. 3, 4 in perspective view, lies in a pot-shaped recess of generator 10.

FIGS. 1–4 show that the insulating body, which is implemented having essentially circular lower face 30*u* and circular upper face 30*o*, has a diameter which essentially corresponds to the clearance of the outer surfaces of latching arms 18.1, 18.2 (in the plugged-in state).

Among other things, two guides 32.1, 32.2 running in plugging direction S, which are used to receive contact pins 16.1, 16.2, are provided in insulating body 30.

A rectangular opening 34 may be seen in lower face 30*u*, which is used to feed a short circuit spring 36, which is illustrated in detail in FIG. 5, during assembly.

The spring is essentially U-shaped, having a bottom leg 36*b* and two U-legs 36*u*1, 36*u*2. Recesses 36*a*1, 36*a*2 run approximately from the middle of bottom leg 36*b* in the direction toward U-legs 36*u*1, 36*u*2 and pass into U-legs 36*u*1, 36*u*2, where approximately central contact tongues 36*z*1, 36*z*2 are simultaneously formed, which are directed toward one another.

External nubs 36*n* may be seen at the transition region between bottom leg 36*b* and U-legs 36*u*1, 36*u*2. Short circuit spring 36 lies on a bottom peripheral step 30*s* of insulating body 30 using these nubs 36*n*. At the same time, bottom leg 36*b* runs essentially parallel to face 30*u* of insulating body 30 and U-legs 36*u*1, 36*u*2 run essentially parallel to contact pins 16.1, 16.2 and/or in plugging direction S.

In the unlocked state of box 10 and plug 12, contact tongues 36*z*1, 36*z*2 press against opposing peripheral surfaces of contact pins 16.1, 16.2, as shown in FIG. 1.

After secondary locking elements 22.1, 22.2 are activated and moved in plugging direction S, they strike at a given time against contact tongues 36*z*1, 36*z*2 and detach them from contact pins 16.1, 16.2 (FIG. 2).

Since U-legs 36*u*1, 36*u*2 run essentially parallel to latching arms 18.1, 18.2 and the movement direction of contact tongues 36*z*1, 36*z*2 is essentially the same as the movement direction of latching arms 18.1, 18.2 (when they snap into latching recesses 20.1, 20.2), the movement latitude necessary for the latching arms lies in the movement direction for latching arms 18.1, 18.2. In this way, short circuit spring 36 may be assembled into insulating body 30 without the plug opening in the box having to be enlarged.

FIG. 6 shows sleeve-like guide means 40.1, 40.2 for contact springs 14.1, 14.2 and—schematically—a further, sleeve-like coding element 42, which is insertable into a corresponding recess 44 in insulating body 30 in order to achieve exact alignment of plug 12 and box 10.

Further coding elements may additionally be arranged on the opposing side of guide means 40.1, 40.2. The coding element(s) generally run(s) essentially axially, i.e., in the plugging direction. They may be made of solid material or may be hollow bodies. They may be designed as ribs, wings, or the like. The adjustment element shown in FIG. 6 has an involute shape in cross-section. A (generally) asymmetrical construction of the individual coding elements ensures that corresponding parts of the plug-in connector are not incorrectly plugged.

Guide means 40.1, 40.2 are rounded at the front (on the free end), at 40.3, 40.4. Together, guide means 40.1, 40.2 arranged next one another may have an arrow-like or dome-like geometry at their free ends 40.3, 40.4.

What is claimed is:

1. An insulating body for installation in a generator as a component of a plug-in connector system having a generator and a plug for inflatable restraint systems in motor vehicles, comprising:

a) An insulating body which has guides running parallel to the plugging direction (S) to receive two contact pins, b) the guides running over the entire height of the insulating body from a lower face to an upper face, c) a U-shaped short circuit spring arranged in the insulating body comprising:

c1) a bottom leg which runs parallel to the lower face of the insulating body, c2) two U-legs which run in the direction toward the upper face of the insulating body and parallel to latching arms of an associated plug, and c3) contact tongues pointed toward one another, which each press against a contact pin in the unplugged state of the plug-in connector system, which project from the U-legs.

2. The insulating body according to claim 1, having a one-piece short circuit spring.

3. The insulating body according to claim 1, having an opening in the lower face which is slightly smaller than the bottom leg of the short circuit spring.

4. The insulating body according to claim 3, wherein the external dimensions of the opening in the lower face are tailored to the external dimensions of the bottom leg of the short circuit spring.

5. The insulating body according to claim 1, whose short circuit spring has at least two recesses in the bottom leg; which encompass the contact pins, with clearance.

6. The insulating body according to claim 5, wherein the recesses are extended into the lateral U-legs and at the same time cut out the contact tongues.

7. The insulating body according to claim 1, wherein the short circuit spring is arranged in such a way that its U-legs press against the contact pins on opposing outer sides.

8. The insulating body according to claim 1, having at least one further receptacle opening in the plugging direction (S) to receive at least one adjustment means as a component of an associated plug.

9. A generator as a component of a plug-in connector system together with a plug for inflatable restraint systems in motor vehicles, having an insulating body according to claim 1, wherein the U-legs of the short circuit spring run essentially parallel to the latching arms of the associated plug.

10. A plug as a component of a plug-in connector system together with a generator for inflatable restraint systems in mother vehicles, having guide means, for contact springs, wherein the guide means are rounded on their front, free ends and arranged juxtaposed to one another, and have an arrow-like or dome-like geometry at their free ends.

* * * * *